US006959162B2

(12) United States Patent
Stelter et al.

(10) Patent No.: US 6,959,162 B2
(45) Date of Patent: Oct. 25, 2005

(54) ELECTROGRAPHIC IMAGE DEVELOPING APPARATUS AND PROCESS

(75) Inventors: Eric C. Stelter, Pittsford, NY (US); Joseph E. Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/812,683

(22) Filed: Mar. 30, 2004

(65) Prior Publication Data

US 2004/0247345 A1 Dec. 9, 2004

Related U.S. Application Data

(60) Provisional application No. 60/459,059, filed on Mar. 31, 2003.

(51) Int. Cl.[7] ..... G03G 15/09

(52) U.S. Cl. ..... 399/267; 399/53; 399/277; 430/111.4; 430/122

(58) Field of Search ..... 399/277, 276, 399/267, 265, 270, 272, 282, 53, 55; 430/122, 111.1, 111.4, 111.41

(56) References Cited

U.S. PATENT DOCUMENTS 4,473,029 A * 9/1984 Fritz et al. ..... 399/276 X
4,602,863 A * 7/1986 Fritz et al. ..... 430/111.4
5,376,492 A * 12/1994 Stelter et al. ..... 430/122
5,489,975 A * 2/1996 Kaukeinen et al. ..... 399/276
5,839,020 A * 11/1998 Rushing et al. ..... 399/49
2002/0168200 A1 * 11/2002 Stelter et al. ..... 399/267
2003/0035663 A1 * 2/2003 Oyama et al. ..... 399/267

FOREIGN PATENT DOCUMENTS

EP 0 625 734 A1 * 11/1994

* cited by examiner

*Primary Examiner*—Sophia S. Chen
(74) *Attorney, Agent, or Firm*—Kevin L. Leffel; Richard A. Romanchik

(57) ABSTRACT

Apparatus and methods for electrographic image development, wherein the image development process is optimized by subjecting the developer to magnetic field maxima, thereby imparting to the developer a velocity component in a direction perpendicular to the process direction, ensuring that the toner particles thus accelerated have sufficient kinetic energy to overcome the binding energy binding the toner particles to the carrier particles in the developer, and to be deposited on a receiver bearing an electrostatic latent image. The optimized image is developed to completion, where development to completion is characterized by a proportionality between the cube of the toner charge to mass ratio and a quantity consisting of the magnitude of the voltage of the toning shell minus the magnitude of the voltage of the toned image.

27 Claims, 12 Drawing Sheets

ELECTROGRAPHIC IMAGE DEVELOPING APPARATUS AND PROCESS

BACKGROUND OF THE INVENTION

The invention relates generally to processes and compositions for electrographic image development or powder deposition. More specifically, the invention relates to compositions and methods for electrographic image development, wherein certain relationships between toner and carrier particle sizes, charges, masses and velocity are optimized for sufficient toner kinetic energy in relation to toner potential energy to allow development to completion. The prior art does not describe optimum relationships between toner and carrier properties such as particle size, particle mass, particle charge or velocity. Accordingly, the optimum relationships for toner and carrier properties have, to date, not been determined taking into account toner kinetic energy or toner potential energy and development to completion.

Processes for developing electrographic images with a magnetic brush using dry toner are well known in the art and are used in many electrographic printers and copiers. Toner application processes utilizing a magnetic brush are also being investigated for powder deposition in powder coating systems. These application processes are elucidated in, for example, L. B. Schein, "Electrography and, Development Physics", Laplacian Press, 1996, the disclosure of which is incorporated herein by reference. The term "electrographic printer," is intended to encompass electrophotographic printers and copiers that employ a photoconductor element, as well as ionographic printers and copiers that do not rely upon a photoconductor, and powder coating devices that deposit toner onto a biased or electrostatically charged receiver. Electrographic printers typically employ a developer having two or more components, consisting of resinous, pigmented toner particles, magnetic carrier particles and other components. The developer is moved into proximity with an electrostatic image carried on a receiver, whereupon the toner component of the developer is deposited on the receiver, Deposition of toner onto the receiver is driven by the electric field between the electrostatic image on the receiver and the magnetic brush. In electrophotographic printers the receiver is a photoconductor and the toner is subsequently transferred to a sheet of paper to create the final image. Developer is moved into proximity with the imaging member by an electrically-biased, conductive toning shell, often a roller that may be rotated co-currently with the imaging member, such that the opposing surfaces of the imaging member and toning shell travel in the same direction. Located adjacent the toning shell is a multipole magnetic core, having a plurality of magnets, that may be fixed relative to the toning shell or that may rotate, usually in the opposite direction of the toning shell.

The developer is deposited on the toning shell and the toning shell rotates the developer into proximity with the imaging member, at a location where the imaging member and the toning shell are in closest proximity, referred to as the "toning nip." In the toning nip, the magnetic carrier component of the developer forms a magnetic brush with a "nap," similar in appearance to the nap of a fabric, on the toning shell, because the magnetic particles form chains of particles that rise vertically from the surface of the toning shell in the direction of the magnetic field. The nap height is maximum when the magnetic field from either a north or south pole is perpendicular to the toning shell. Adjacent magnets in the magnetic core have opposite polarity and, therefore, as the magnetic core rotates, the magnetic field also rotates from perpendicular to the toning shell to parallel to the toning shell. When the magnetic field is parallel to the toning shell, the chains collapse onto the surface of the toning shell and, as the magnetic field again rotates toward perpendicular to the toning shell, the chains also rotate toward perpendicular again. Thus, the carrier chains appear to flip end over end and "walk" on the surface of the toning shell and, when the magnetic core rotates in the opposite direction of the toning shell, the chains walk in the direction of imaging member travel.

As the carrier chains move in response to the magnetic field, toner particles attracted to the carrier particles by electrostatic interactions are drawn along with the carrier particles. Electrographic printing is based on the electrostatic Coulomb force, $F_{Coul}$, and the force from the electric field of image development, qE. For toner of charge $Q_T$=q, and carrier of charge $Q_C$=−q, the Coulomb force component of the attractive force between a charged toner particle on the surface of a charged carrier particle is proportional to:

$$F_{Coul}=-q^2/(R_C+R_T+s)^2, \quad (1)$$

where $R_C$ is the radius of the carrier particle, $R_T$ is the radius of the toner particle, and s is the separation between the particle surfaces. The prior art commonly models toner particles as spheres with uniform charge distributions, thus allowing a toner particle of total charge q and approximate radius $R_T$ to be represented as a point charge q at the center of a sphere. As toner size is increased or decreased, for tribocharged toners, the total charge usually increases or decreases proportionally with the surface area. In other words, for a given toner and carrier formulation, the charge density per unit area is approximately constant as toner size is changed.

Other attractive forces involved in toner-carrier interactions include charge induced polarization, i.e., forces arising from an electrostatic image charge induced in the carrier particle by an adjacent toner particle and, likewise, from polarization induced in the toner particle by an adjacent carrier particle. Additionally, field induced polarization arises from the polarization of each particle in the external electric field of image development. Furthermore, non-uniform charge distributions on toner particles resulting from unequal distribution of charge arising from tribocharging have recently been found to be a major component of the binding force. Finally, dispersion forces or Van der Waals forces act to bind the toner particle to the carrier particle, as well as capillary forces due to adsorbed films of water on toner and carrier surfaces. These forces are referred to as adhesion forces $F_a$, and generally act over short ranges and are nearly the same magnitude or greater than the Coulomb force $F_{Coul}$ binding toner to the carrier at very short separation distances. Additional forces on toner include impact forces due to collisions and viscous drag during motion of toner through air. These are also of approximately the same magnitude as the Coulomb force binding the toner to the carrier.

For toning to occur, according to the prior art, the force from the electrographic image qE plus the force from the electrographic image carried on the imaging member must be greater than $q^2/(R_C+R_T)^2$ plus the force due to image charges in the carrier and other attractive forces on the toner. The prior art disclosed in Schein describes several theories of development. First, the "neutralization theory" assumes that development occurs until the toner charge per unit area completely neutralizes the imaging member charge. Second, the "field stripping" theory assumes that toner is stripped from the carrier when the qE force due to the electric field of the image overcomes the total force of adhesion of toner to carrier. Third, the "powder cloud" theory assumes that a cloud of toner is produced in the development region and then collected by the electric field associated with the image. Powder cloud development was originally associated with cascade toning and was extended to magnetic brush development. Several authors have concluded that this is a small component of development compared to the principle magnetic brush development process and that it possibly contributes to background toning.

Finally, the "equilibrium" theory holds that toner develops only in three-body contact events in which the toner simultaneously contacts both the carrier and the electrographic imaging member, and toner adhesion forces to the carrier are balanced by toner adhesion to the imaging member. The equilibrium theory includes aspects of the field stripping model, surface forces, and residual charge on the carrier particles. It is the most widely accepted model of toning at the present time. All descriptions of the equilibrium theory incorporate the same forces that would be present if the developer and imaging member were stationary, rather than in motion relative to each other.

There are three versions of the equilibrium theory, differing in their respective prediction of when toning stops. In the first variant of the equilibrium theory, toning is predicted to stop when the forces on the nth toning particle from the carrier are equal and opposite to forces from the imaging member. In a second variant of the equilibrium theory, toning is predicted to stop when the electric field in the air gap between the separated toner and carrier vanishes. Finally, in the third variant, toning is predicted to stop when the total charges in a volume (Gaussian pillbox) with one end in the air gap outside of the toner layer on the image and the other end in the imaging member ground plane equals zero.

All of the foregoing theories take into account only forces that would be the same if the imaging member or developer were not moving. None of these prior art models explicitly incorporates the carrier velocity perpendicular to the imaging member surface or the properties of the collisions of toner or carrier with the imaging member to explain when development will occur.

Accordingly, there is a need in the art for an electrographic image development process that incorporates optimum relationships between toner and carrier characteristics and properties, taking into account the kinetic energy of the developer particles as they move perpendicular to the imaging member in response to magnetic pole transitions resulting from the action of a rotating magnetic field vector.

DETAILED DESCRIPTION

Figure 1:
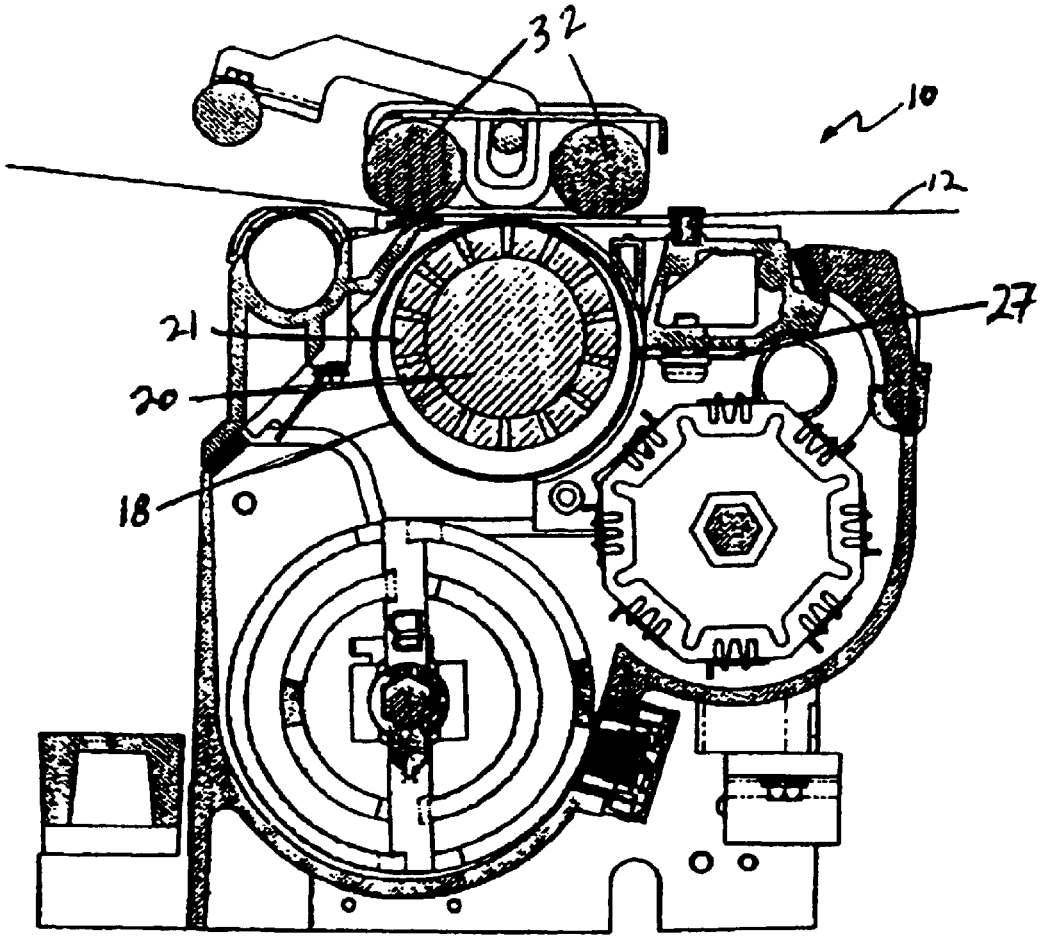
FIG. 1 presents a side view of an apparatus for developing electrographic images, according to an aspect of the invention.

Electrographic printing apparatus and methods are provided, according to various aspects of the invention. The apparatus may include an imaging member, a toning shell located adjacent the imaging member and defining an image development area therebetween, through which developer is passed.

A magnetic field may be provided, modulated such that the developer passing through the image development area is subjected to magnetic pole transitions at a rate exceeding 257 pole transitions per second as measured from the frame of reference of a stationary observer. In a preferred embodiment, modulation of the magnetic field is accomplished by providing a rotating magnetic core adjacent the toning shell, the magnetic core having a plurality of magnets, arranged such that adjacent magnets have opposite polarity. Alternatively, modulation of the magnetic field may be accomplished by providing an array of fixed magnets located and arranged such that the developer passing through the image development area is subjected to magnetic pole transitions, or by providing at least one solenoid that may be pulsed to cause magnetic pole transitions.

The developer to maybe subjected to magnetic pole transitions at a rate exceeding 257 pole transitions per second, as measured from the frame of reference of a stationary observer, preferably exceeding 266 pole transitions per second, and more preferably exceeding 274 pole transitions per second. Alternatively, the rate of pole transitions preferably exceeds 271 pole transitions per second as measured from the frame of reference of an observer moving through the image development area, preferably exceeds 281 pole transitions per second, more preferably exceeds 289 pole transitions per second and more preferably exceeds 294 pole transitions per second.

The toning shell may comprise a toning shell voltage, the imaging member comprising a developed image, and the developed image comprises a developed image voltage. The toning shell voltage minus the imaging voltage being proportional to a toner charge to mass ratio of the developer cubed. The toner charge to mass ratio may be determined by measurement, for example.

The toning shell may comprise a toning shell voltage, the imaging member comprising a developed image, and the developed image comprising a developed image voltage. The toning shell voltage minus the developed image voltage being proportional to average charge per toner particle of the developed image cubed. The average charge per toner particle may be determined by measurement, for example.

The developer may comprise toner and carriers, the toner comprising a toner charge, the carrier comprising a carrier charge, the toner charge being proportional to the carrier charge.

According to another aspect, an electrographic printer comprising an imaging member, a toning shell located adjacent the imaging member and defining an image development area therebetween, through which developer is passed. A rotating magnetic core comprising a plurality of magnetic poles arranged such that adjacent poles are of opposite polarity, the magnetic core located adjacent the toning shell. The developer comprising carrier particles, the developer comprising a measured dielectric length that is less than 3 times the average diameter of the carrier particles, and preferably less than 3 times the average diameter of the carrier particles.

The developer may comprise surface treated toner, and/or polyester toner. A surface treated toner may be a polyester toner.

Figure 2:
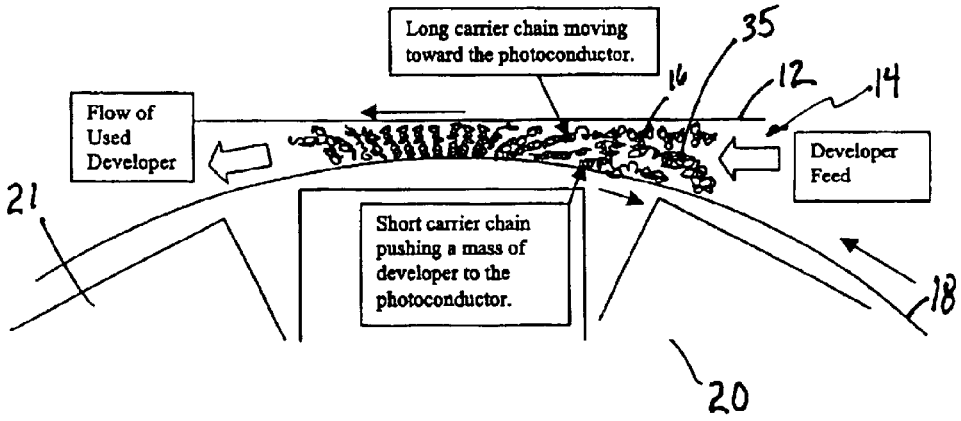
FIG. 2 presents a side cross-sectional view of an apparatus for developing electrographic images, according to an aspect of the present invention.

Various aspects of the invention are presented in Figures, which are not drawn to scale, and wherein like components in the numerous views are numbered alike. FIGS. 1 and 2 depict an exemplary electrographic printing apparatus according to an aspect of the invention. An apparatus 10 for developing electrographic images is presented comprising an electrographic imaging member 12 on which an electrostatic image is generated, and a magnetic brush 14 comprising a rotating toning shell 18, a mixture 16 of hard magnetic carriers and toner (also referred to herein as "developer"), and a magnetic core 20. In a preferred embodiment, the magnetic core 20 comprises a plurality of magnets 21 of alternating polarity, located inside the toning shell 18 and rotating in the opposite direction of toning shell rotation, causing the magnetic field vector to rotate in space relative to the plane of the toning shell. Alternative arrangements are possible, however, such as an array of fixed magnets or a series of solenoids or similar devices for producing a magnetic field, so long as there is a magnetic field produced and the magnetic field is modulated such that the developer is subjected to magnetic pole transitions. By the terms "modulated" or modulating the magnetic field" is meant any method of creating a magnetic field having alternating magnetic maxima, i.e., maxima either of alternating polarity or by creating magnetic maxima of the same polarity that are switched on and off cyclically. While the following discussion of preferred embodiments focuses on a rotating magnetic core that subjects the developer to rapidly alternating magnetic maxima of opposite polarity, persons of ordinary skill in the art will undoubtedly recognize other methods of modulating the magnetic field, in addition to those described above.

Likewise, in a preferred embodiment, the imaging member 12 is a receiver for toner and is configured as a sheet-like film. However, the imaging member may be configured in other ways, such as a drum or as another material and configuration capable of retaining an electrostatic image or providing an electric field to the magnetic brush, and used in electrophotographic, ionographic, powder coating or similar applications. The film imaging member 12 is relatively resilient, typically under tension, and a pair of backer bars 32 may be provided that hold the imaging member in a desired position relative to the toning shell 18, as shown in FIG. 1. A metering skive 27 may be moved closer to or further away from the toning shell 18 to adjust the amount of toner delivered.

In a preferred embodiment, the imaging member 12 is rotated at a predetermined imaging member 12 velocity in the process direction, i.e., the direction in which the imaging member travels through the system, and the toning shell 18 is rotated with a toning shell 18 surface velocity adjacent and co-directional with the imaging member 12 velocity. The toning shell 18 and magnetic core 20 bring the developer 16, comprising hard magnetic carrier particles and toner particles into contact with the imaging member 12. The imaging member 12 in electrophotographic applications contains a dielectric layer and a conductive layer, is electrically grounded and defines a ground plane. The surface of the imaging member 12 facing the toning shell 18 can be treated at this point in the process as an electrical insulator with imagewise charge on its surface, while the surface of the toning shell 18 opposite that is an electrical conductor. For powder coating applications, an imaging member or receiver can be used that is a biased conductor or an electrostatically-charged insulator. Biasing the toning shell 18 relative to ground with a voltage creates an electric field that attracts toner particles to the electrographic image or to the electrographic receiver with a uniform toner density, the electric field being a maximum where the toning shell 18 is adjacent the imaging member 12. The imaging member 12 and the toning shell 18 define an area therebetween known as the toning nip 34, also referred to herein as the image development area. Developer 16 is delivered to the toning shell 18 upstream from the toning nip 34 and, as the developer 16 is applied to the toning shell 18, the average velocity of developer 16 through the narrow toning nip 34 is initially less than the developer 16 velocity on other parts of the toning shell 18. Therefore, developer 16 builds up immediately upstream of the toning nip 34, in a so-called rollback zone 35, until sufficient pressure is generated in the toning nip 34 to compress the developer 16 to the extent that it moves at the same bulk velocity as the developer 16 on the rest of the toning shell 18.

According to an aspect of the invention, the magnetic brush 14 operates according to the principles described in U.S. Pat. Nos. 4,473,029 and 4,546,060, the contents of which are fully incorporated by reference as if set forth herein. The two-component dry developer composition of U.S. Pat. No. 4,546,060 comprises charged toner particles and oppositely charged, magnetic carrier particles, which comprise a magnetic material exhibiting "hard" magnetic properties, as characterized by a coercivity of at least 300 gauss and also exhibit an induced magnetic moment of at least 20 EMU/gm when in an applied field of 1000 gauss, is disclosed. In a preferred embodiment, the toning station has a nominally 2" diameter stainless steel toning shell containing a magnetic core having fourteen poles, adjacent magnets alternating between north and south polarity. Each alternating north and south pole has a field strength of approximately 1000 gauss. The toner particles have a nominal diameter of 11.5 microns, while the hard magnetic carrier particles have a nominal diameter of approximately 26 microns and resistivity of $10^{11}$ ohm-cm. Although described in terms of a preferred embodiment involving a rotating, multipole magnetic core, it is to be understood that the invention is not so limited, and could be practiced with any apparatus that subjects the carrier particles to a magnetic field vector that rotates in space or to a magnetic field of alternating direction, as for example, in a solenoid array.

Figure 3:
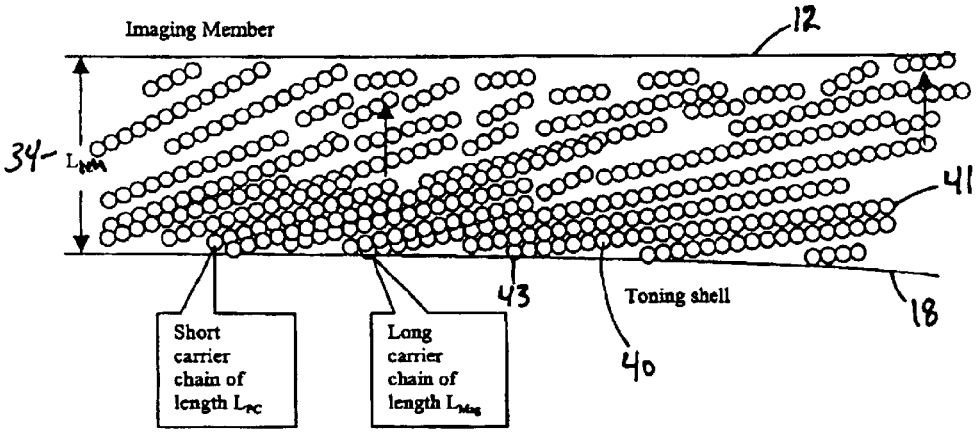
FIG. 3 presents a diagrammatic view of the toning nap created by the operation of the apparatus depicted in FIG. 2.

As depicted diagrammatically in FIGS. 2–3, when hard magnetic carrier particles are employed, the carrier particles form chains 40 under the influence of a magnetic field created by the rotating magnetic core 20, resulting in formation of a nap 38 as the magnetic carrier particles form chains 40 of particles that rise from the surface of the toning shell 18 in the direction of the magnetic field, as indicated by arrows. The nap 38 height is maximum when the magnetic field from either a north or south pole is perpendicular to the toning shell 18, however, in the toning nip 34, the nap 38 height is limited by the spacing between the toning shell 18 and the imaging member 12. As the magnetic core 20 rotates, the magnetic field also rotates from perpendicular to the toning shell 18 to parallel to the toning shell 18. When the magnetic field is parallel to the toning shell 18, the chains 40 collapse onto the surface of the toning shell 18 and, as the magnetic field again rotates toward perpendicular to the toning shell 18, the chains 40 also rotate toward perpendicular again.

Each flip, moreover, as a consequence of both the magnetic moment of the particles and the coercivity of the magnetic material, is accompanied by a rapid circumferential step by each particle in a direction opposite the movement of the magnetic core 20. Thus, the carrier chains 40 appear to flip end over end and "walk" on the surface of the toning shell 18. In reality, the chains 40 are forming, rotating, collapsing and re-forming in response to the pole transitions caused by the rotation of the magnetic core 20, thereby also agitating the developer 16, freeing up toner to interact with an electrostatic field of the imaging member 12, as discussed more fully below. When the magnetic core 20 rotates in the opposite direction of the toning shell 18, the chains 40 walk in the direction of toning shell 18 rotation and, thus, in the direction of imaging member 12 travel.

The free ends 41 of the carrier chains 40 describe an arcuate path as they move in response to the rotation of the magnetic field, and the velocity of the free end 41 of the carrier chain 40 outside of the toning nip 34 is given by multiplying the chain length times the angular velocity of the magnetic field, plus a contribution from the velocity of the toning shell 18. The term "free end" is meant to refer to the end 41 of the carrier chain 40 opposite the end 43 in contact with the toning shell 18. For a magnetic core 20 having fourteen poles rotating at approximately 1100 RPM, the magnetic field flips approximately 14×1100/60=257 times per second. Each transition from a N pole to a S pole corresponds to a rotation of the magnetic field by 180 degrees or π radians, and the angular frequency of rotation for the magnetic field $\omega_{Mag}$ equals the number of pole transitions per second×π. In this case, for a stationary observer, $\omega_{Mag}$=806 radians/sec. At 17.49 ips imaging member speed $v_{IM}$ with a toning nip 34 width of approximately 0.375", each point on the imaging member 12 is exposed to at least 5 north or south magnetic poles as it passes through the toning station. Thus, under these conditions, the carrier chains 40 are formed and collapse approximately 5 times during development of a point on the image 12.

Preferably, the resulting average developer bulk velocity is substantially equal to the imaging member velocity, as set forth in co-pending U.S. Pat. application Ser. No. 09/855,985, filed May 15, 2001 now U.S. Pat. No. 6,728,503, in the names of Stelter, Guth, Mutze, and Eck, the contents of which are hereby incorporated herein by reference. While that application addressed relative velocities of the imaging member 12 and the bulk velocity of developer 16, the present invention focuses on instantaneous values of particle velocity that have components perpendicular to the imaging member, rather than parallel to the process direction. Therefore, for the purposes of this discussion, it will be assumed that the imaging member 12 velocity equals the average developer bulk velocity and, therefore, there is no relative motion between the imaging member 12 and the developer 16 in the process direction. When there is some such relative motion in the process direction, the average developer 16 velocity through the toning nip 34 contributes to the rate γ of pole transitions experienced by the developer 16. For a magnetic core 20 with n poles per inch, with the field from the poles appearing to a stationary observer to move at a surface velocity $v_M$ on the toning shell 18 and countercurrent to a developer moving at velocity $v_D$, $$\gamma = n \times (v_D + v_M) \tag{2}$$

and $$\omega_{Mag} = \pi\gamma \tag{3}$$

where $v_D$ and $v_M$ are the magnitudes of the velocities in inches per second. If the magnetic core 20 is rotating cocurrent with the developer 16 velocity, Equation (2) would be modified to read:

$$\gamma = n \times (v_D - v_M) \tag{2'}$$

For a toning shell 18 approximately 2 inches in diameter and a fourteen-pole magnetic core 20 with alternating N and S poles rotating at approximately 1100 RPM, there are, to a stationary observer, 256 pole transitions per second. For 2.23 poles per inch in the toning nip 34, to a stationary observer, this corresponds to a velocity for the magnetic poles 21 on the toning shell 18 surface of $v_M$=2π×1100/60=115.19 in/sec. Assuming for the preferred embodiment that the developer 16 moves at a bulk velocity equal to the speed of the imaging member, $v_D$=17.49 in/sec., and including the effects of developer velocity, the developer 16 experiences 296 pole transitions per second as it moves through the toning nip 34, or approximately thirty-nine transitions per second more than if it were stationary. The corresponding angular frequency $\omega_{Mag}$=930 radians/sec in the reference frame of the developer.

Although exact details of developer motion inside the toning nip 34 are not entirely known, reasonable assumptions can be made based on certain observations and physical principles. First, as diagrammatically depicted in FIGS. 3–5, carrier particles may form chains 40 at the beginning of each walk cycle that can be a natural length, denoted by $L_{Mag}$, equal to the height of the nap 38, and determined by the magnetic field of the toning station. The nap 38 height $L_{Mag}$ may be measured optically with a Keyence LX2-11 laser and detector array (Keyence Corporation of America, 649 Gotham Parkway, Carlstadt, N.J. 07072). This unit produces a voltage that decreases linearly if the laser beam is blocked by an object moving in front of the detectors. To measure nap 38 height, the toning station is removed from the machine and run on a benchtop with the imaging member 12 removed. The average carrier chain 40 length equals the average distance from the surface of the toning shell 18 occupied by the developer 16 when the carrier chains 40 are standing upright, perpendicular to the surface of the toning shell 18. Measurements are taken using the laser, of a bare toning shell and also with developer 16 flowing on the shell. The difference in voltage is converted to height (in inches) using a calibration factor.

Another possibility is that some of the carrier chains 40 in the toning nip 34 at the beginning of a typical walk cycle have a length determined by the distance between the toning shell 18 and the imaging member 12. The nominal imaging member 12 spacing to the toning shell 18, denoted $L_{IM}$, is approximately 0.014", although actual $L_{IM}$ is probably closer to 0.018 inches, given the flexibility of the imaging member 12, and when the toning station is run in the machine, carrier chains 40 are present at the beginning of each walk cycle that have been cut to this length by previous collisions with the imaging member 12.

In reality, each of the foregoing theories probably contributes to the observed chain 40 length to some extent and, therefore, there is probably a distribution of carrier chains 40 having actual lengths between these two extremes. The average of the two extremes is a chain length of 0.033 inches, and this is probably a good estimation of the actual average chain length.

The carrier particles start each magnetic field cycle lying on the surface of the toning shell 18, with the magnetic field parallel to the toning shell 18. As the magnetic field starts rotating toward perpendicular (or normal to the toning shell 18 surface and the imaging member 12 surface), the ends 41 of developer chains 40 move toward the imaging member 12, and developer 16 in the toning nip 34 adjacent to the imaging member 12 is pushed toward the imaging member as shown in FIG. 3. If the toning nip 34 is packed with enough developer 16 that the motion of one carrier particle toward the imaging member affects the motion of adjacent particles, the carrier particles adjacent the imaging member 12 surface move with a velocity perpendicular to the process direction, at a rate that ranges up to the maximum perpendicular velocity of any of the carrier particles between the imaging member 12 and the toning shell 18. For a carrier chain 40 of length L, in the reference frame of the receiver, the velocity perpendicular to the process direction at the end 41 of the chain 40 equals $$v=L\times\pi\gamma \tag{4}$$

or $$v=L\times\omega_{Mag} \tag{5}$$

In a preferred embodiment, the maximum chain length $L_{Mag}$ of approximately 0.048 inches, produces a maximum velocity of approximately 44.6 inches per second. At the same instant, motion of the shortest carrier chains of length $L_{IM}$ produces a maximum velocity, for the shortest chains, of approximately 16.7 inches per second toward the imaging member 12. The average velocity of carrier particles toward the imaging member can be estimated in several ways, all of which produce approximately the same estimated velocity. Assuming that the population of carrier chains is equally distributed between these lengths, if the average velocity of a carrier particle propelled toward the imaging member is determined by the more rapidly moving outer half of several carrier chains with a range of lengths between these extremes, the average velocity toward the imaging member of carrier particles that are being moved in this direction is approximately 23 inches/sec. Alternatively, if most carrier chains are of length 0.033 inches equal to the average of the two extremes, the maximum velocity would be approximately 30.7 inches/sec, and the average velocity of the more rapidly moving outer half of each chain would be 23 inches/sec. The range of velocities is determined by the two extremes of chain length, and if the average velocity of carriers colliding with the imaging member is determined by more than one chain, the average velocity is probably relatively independent of the exact nature of the distribution of carrier chain lengths.

Figure 4:
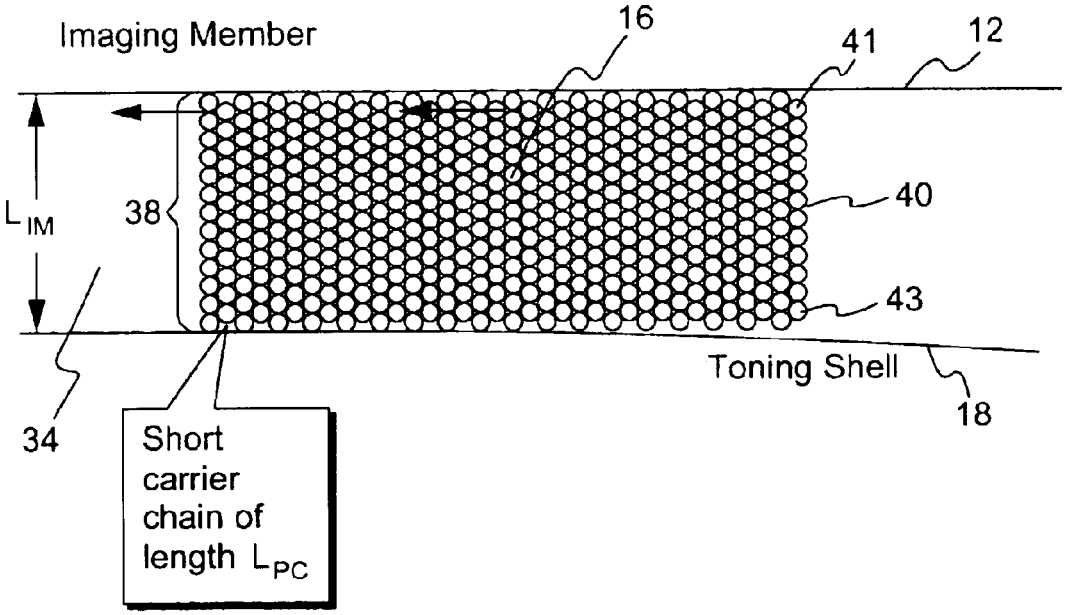
FIG. 4 presents a diagrammatic view of the toning nap created by the operation of the apparatus depicted in FIG. 2.
Figure 5:
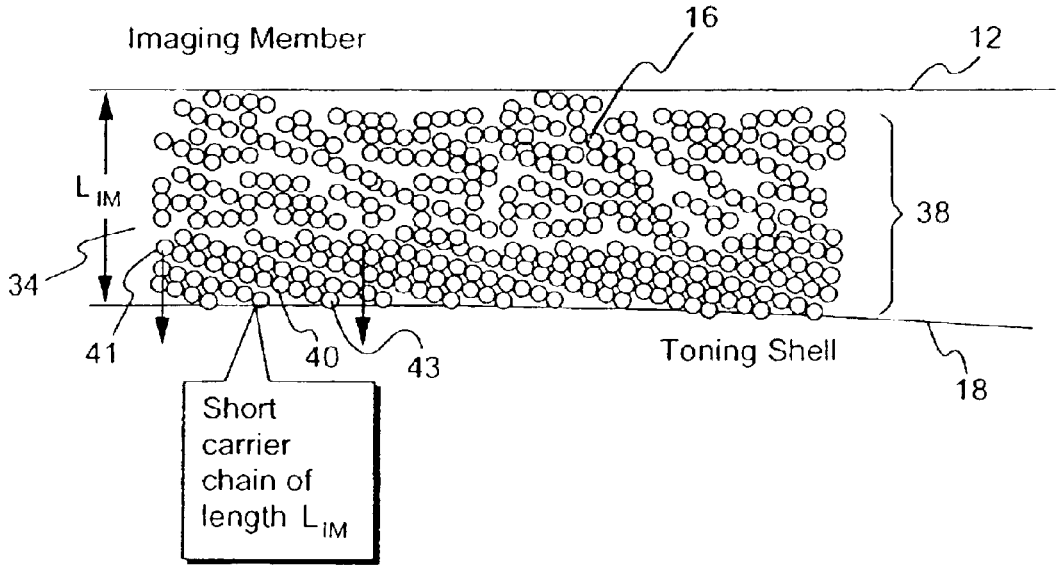
FIG. 5 presents a diagrammatic view of the toning nap created by the operation of the apparatus depicted in FIG. 2.

As the magnetic field continues to rotate, it is briefly oriented perpendicular to the imaging member, as shown in FIG. 4, and the carrier particles will tend to align with the magnetic field. As the magnetic pole 21 moves out of the toning nip 34, the magnetic field rotates from vertical to horizontal as shown in FIG. 5. The carrier chains 40 have probably been truncated by contact with the imaging member 12, shortening the chains 40 to length $L_{IM}$, and although some carrier particles will recombine to form chains of natural length $L_{Mag}$, the most likely maximum velocity toward the shell as the magnetic field approaches horizontal is $L_{IM}\times\omega_{Mag}$=16.7 ips, and the average velocity of the more rapidly moving half of each chain will be approximately 12.5 ips. For typical toner used in all the examples of this disclosure, diameter=11.5 microns, density is assumed to be 1 g/cc, and mass is $M_T=7.96\times10^{-10}$ g. Toner kinetic energies, given by ½ $M_T v^2$ for the typical velocities in the system are given in TABLE 1.

TABLE 1

Toner kinetic energy for typical developer velocities at $\omega_{Mag}$ = 930 radians/sec.

| Velocity (ips) | Corresponding Length (in) | Kinetic energy (ergs × $10^{-6}$) |
|---|---|---|
| 44.6 | 0.0480 | 5.1 |
| 33.4 | 0.0360 | 2.9 |
| 23 | 0.0248 | 1.4 |
| 16.7 | 0.0180 | 0.72 |
| 12.5 | 0.0135 | 0.40 |

Although the discussion has so far concentrated on a toning station having a rotating magnetic core producing a rotating magnetic field, other toning station design formats are possible, so long as there is some provision for magnetic field modulation, i.e., creating alternating magnetic pole maxima, either that alternate as to polarity, that change direction, or that cycle on and off with the same polarity, or through another method known to those skilled in the art. For example, the magnetic core may be replaced with an array of fixed magnets, of like or alternating polarity, or the magnetic field may emanate from a pulsed solenoid or solenoid array.

In general, for other toning station designs, γ is the rate of magnetic pole maxima per second for developer moving in proximity to an imaging member in the reference frame of developer motion. In the preferred embodiment, the reference frame of developer motion is also the reference frame of the receiver. For Equation (2), n is the number of N or S poles per inch. If the magnetic core is stationary, $v_M$=0. Typically, grooved or roughened toning shells are used with stationary magnetic cores, and $v_D$ in this case is approximately equal to the velocity of the toning shell. The angular frequency $\omega_{Mag}$ is given by Equation (3). For continuously moving magnetic fields with an angular frequency, the velocity component of the developer perpendicular to the receiver is given by Equation (5), where L is the effective chain length. If the magnetic field is generated by other means, for example, by a solenoid pulsed at a frequency γ, Equation (3) is also approximately true, and the velocity is approximately given by Equation (4) or by Equation (6) below, which more accurately takes into account the creation and destruction of a chain between pulses.

$$\omega_{Mag}=2\gamma \text{ and } v\sim L\times 2\gamma \tag{6}$$

In all cases, the average toner kinetic energy is given by $$\tfrac{1}{2}M_T v^2=\tfrac{1}{2}M_T(L\omega_{Mag})^2 \tag{7}$$

where L is the average effective length of the carrier chains 40.

The discussion thus far has focused on the motion of the carrier chains 40, in response to the rotation of the magnetic field, as well as a description of the velocity of individual carrier particles resulting from this motion. The significance of the phenomenon described above lies in its relation to toning, or the deposition of toner onto the imaging member or onto the receiver, which is believed to relate to the impact of the developer on the imaging member, as discussed below.

When the carrier chains 40 rotate toward the imaging member 12, as depicted in FIG. 3, the arcuate motion of the carrier chains 40 imparts a large velocity component in the direction of the imaging member 12, i.e., roughly perpendicular to the process direction. This is the largest velocity toward any surface with which the carrier chains 40 can collide, and this large velocity during the collision of the carrier chains 40 with the imaging member 12 is believed to play a significant role in the toning process. The following analysis of collisions for a preferred embodiment of the invention will be discussed in the reference frame of the carrier or of the imaging member 12, assuming that the carrier particle is traveling perpendicular to the imaging member 12. In other words, the instantaneous relative velocity of carrier particles parallel to the imaging member surface is on average approximately zero in a preferred embodiment. Additionally, on average, there are 5 or less toner particles 52 associated with a given carrier particle 50. This relationship may be calculated from the nominal toner concentration of 10% by weight, for toner particles of diameter 11.5 microns having a density of approximately 1 g/cm$^3$ and for carrier particles having the most likely size of 26 microns diameter and a density of approximately 3.5 g/cm$^3$. The toner particles are distributed randomly throughout the developer, and this random distribution is maintained by the agitation discussed above. The following discussion focuses on the interaction of a single toner particle with a single carrier particle, although additional toner particles could be added by superposition. For a typical toner of particle of mass $M_T=7.96\times10^{-10}$ g and charge-to-mass ratio of approximately −20 $\mu$C/g, the average toner charge is $Q_T=-1.59\times10^{-14}$ C$=-4.77\times10^{-5}$ esu$=9.94\times10^{4}$ electrons. For simplicity, positive toner charges are assumed in the following discussion.

Figure 6:
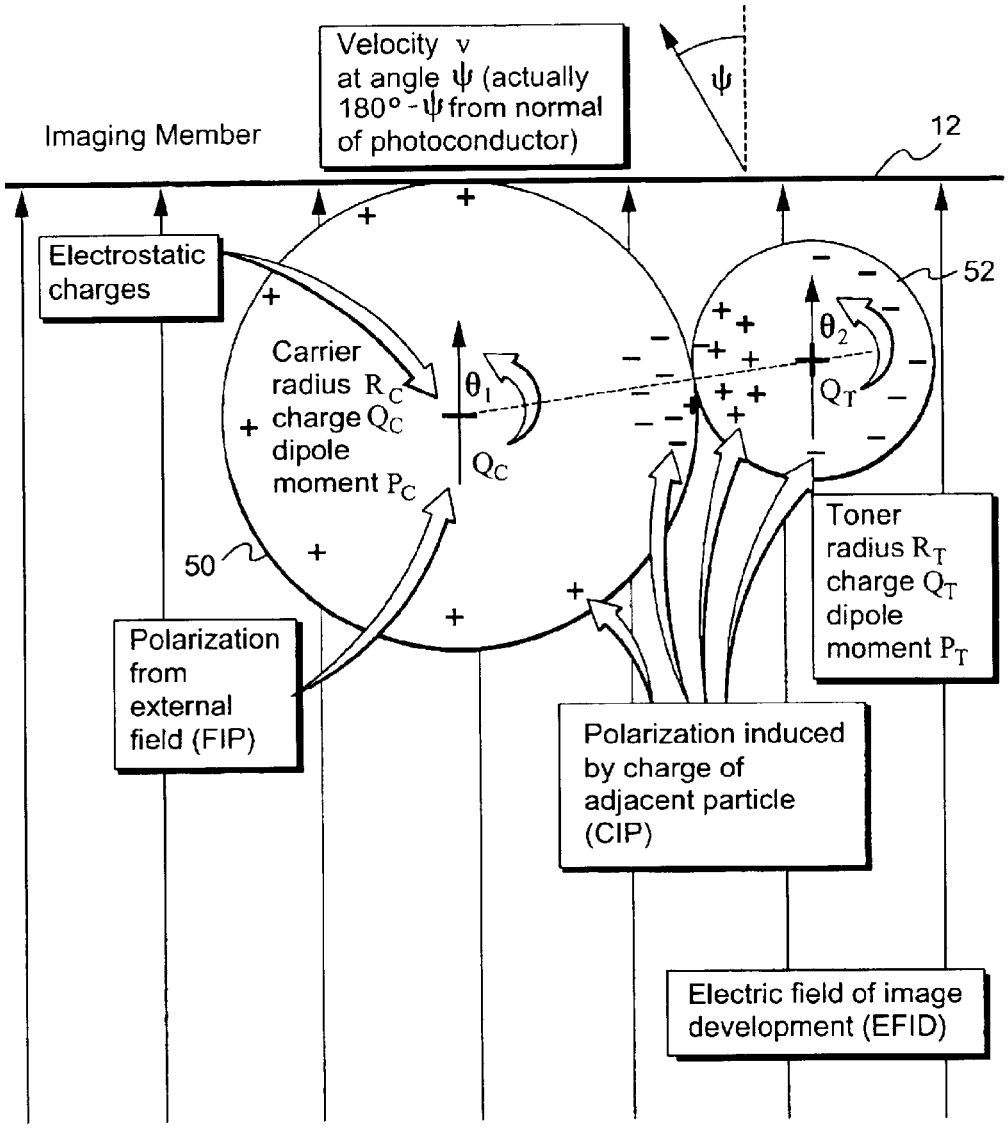
FIG. 6 presents a diagrammatic view of a collision between a carrier particle-toner particle pair and an imaging member, where the carrier particle strikes the imaging member first.
Figure 7:
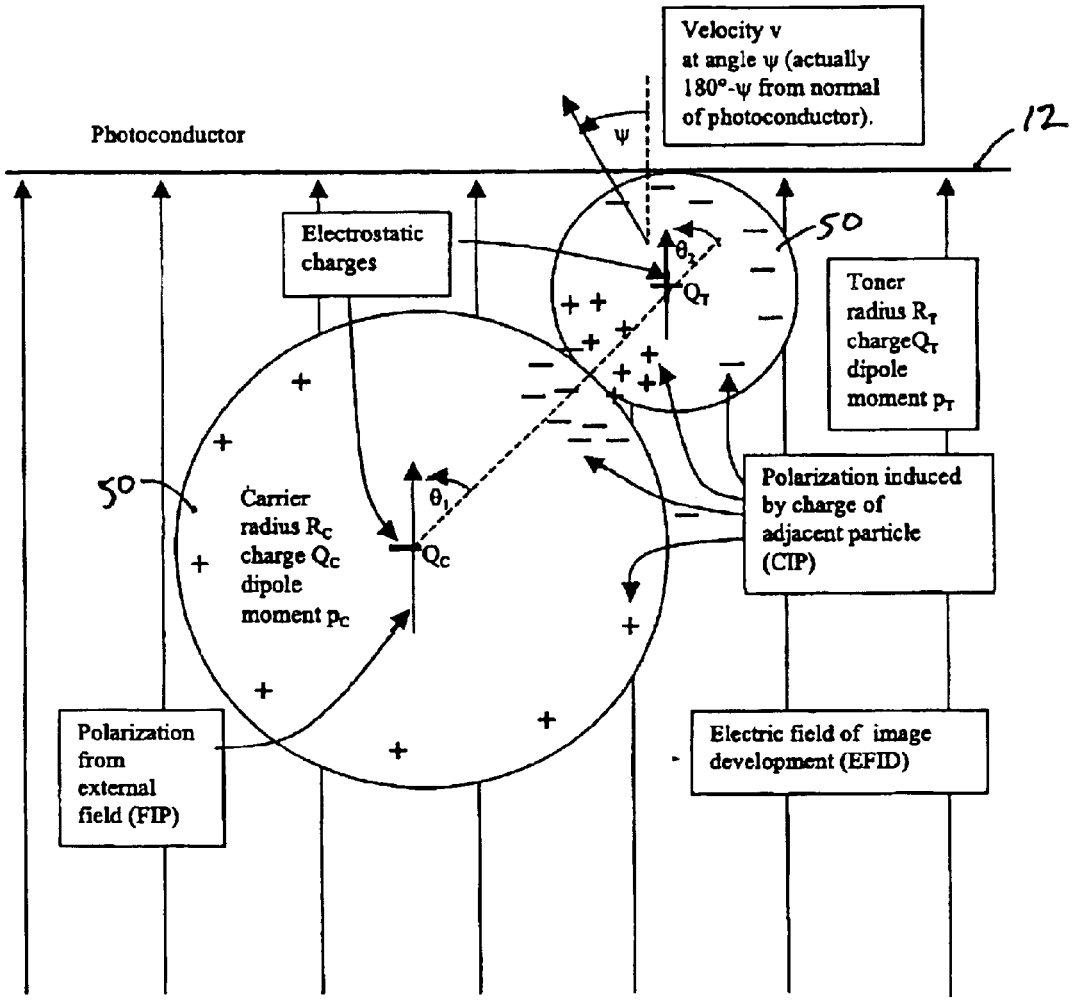
FIG. 7 presents a diagrammatic view of a collision between a carrier particle-toner particle pair and an imaging member, where the toner particle strikes the imaging member first.

The collision of a carrier particle 50 and an attached toner particle 52 with the imaging member 12 is shown schematically in FIG. 6. In the imaging member 12 reference frame, before the collision, both the carrier particle 50 and the toner particle 52 are traveling at approximately the same velocity. During the collision the carrier particle 50 stops and the toner particle 52 keeps going, or vice versa. A collision in which the toner particle hits the imaging member first is shown in FIG. 7. The carrier particle 50 has mass $M_C$ and radius $R_C$, while the toner particle 52 has mass $M_T$ and radius $R_T$. If the toner particle 52 has sufficient kinetic energy, ½ mv$^2$, it can be freed from the potential of the carrier particle 50, U(r,θ,E), and deposited on the imaging member 12 surface. The potential U(r,θ,E) is the total potential energy, incorporating electrostatic terms representing Coulomb forces and polarization terms, van der Waals terms, and it can also include contributions from non-uniform charge distributions and additional forces. The potential depends on particle sizes and material properties not explicitly listed as variables, and will be denoted as U(r) for brevity.

Figure 8:
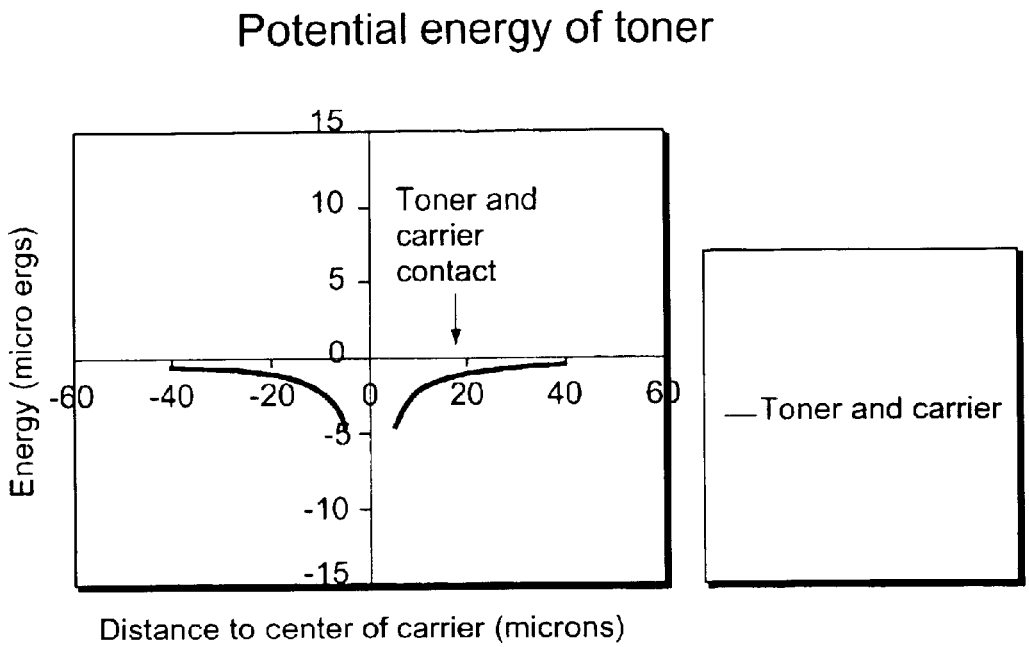
FIG. 8 presents a plot of toner potential as a function of the separation distance between the centers of toner particle and carrier particle.

Assuming that the total charge of a toner-carrier pair is zero, the potential energy $-q^2/r$ (ergs) of an average or representative toner particle 52 on a typical carrier particle 50 due to the Coulomb force $-q^2/r^2$ (dynes) is shown schematically in FIG. 8. The particles are assumed to be spherical, and the charges on the toner particle 52 and the carrier particle 50 are assumed to be uniformly distributed on the surfaces of the particles. The distance from the center of the carrier particle 50 to the center of the toner particle is designated r. The toner particle 52 is assumed to have charge $Q_T$=q and mass $M_T$=m. In this simple case, the Coulomb force is $6.5\times10^{-4}$ dynes, and a kinetic energy for the toner particle of ½ mv$^2=1.22\times10^{-6}$ ergs is required to free the toner particle 52 from Coulomb forces binding it to the carrier particle 50. By solving for velocity, it can be seen that this kinetic energy limit will be exceeded if the toner particle 52 strikes the imaging member 12 with a velocity exceeding 21.8 inches per second. This is approximately the average velocity perpendicular to the imaging member surface for carrier particles 50 and toner particles 52 at the start of the pole flip cycle that was calculated earlier, and is well within the range of carrier particle 50 velocities.

Thus, a general condition may be derived for toner charge to mass ratio (q/m) and velocity. Equating kinetic energy and Coulomb potential energy to find a minimum escape velocity, for toner of mass $M_T$=m (in cgs units):

$$\frac{1}{2}mv^2 \geq \frac{q^2}{(R_C+R_T)} \tag{8}$$

Other potential energy functions for toner can be substituted for the right hand side of Equation (3). Taking other attractive forces into account, such as short range forces, the force from the electrostatic image of the toner charge in the carrier, and vice versa $$\left(\frac{q}{m}\right)^2 \leq \frac{1}{2}\frac{(R_C+R_T)}{m}v^2 \tag{9}$$

For toners of 11.5 microns diameter and carriers of 26 microns diameter, this results in q/m ≦21 $\mu$C/g for development at the average normal chain velocity of 23 ips. For the velocity of 33.4 ips, q/m≦31 $\mu$C/g. Using the assumption of spherical toner particles with density ρ g/cm$^3$, $$m=(4/3)\pi\rho R_T^3 \tag{10}$$

$$q^2 \leq \frac{2}{3}\pi\rho R_T^3(R_C+R_T)v^2 \tag{11}$$

If particle charge is proportional to the particle surface area so that the toner surface charge density $\sigma_T$ is independent of toner size, $$q=4\pi R_T^2\sigma_T \tag{12}$$

and $$\sigma_T^2 \leq \frac{1}{24\pi}\rho\frac{(R_C+R_T)}{R_T}v^2 \tag{13}$$

For the example toner, $\sigma_T=2\times10^{-10}$ statcoul/cm$^2$. These equations are in the cgs system of units which uses centimeters, grams, seconds, ergs, dynes, statcoulomb (or esu) and statvolts. 2998 statcoulomb=1 $\mu$Coulomb and 1 statvolt=299.8 volts.

It should be recognized that the Coulomb potential energy is a representative potential energy, and that more complicated potential energy functions can be used in the foregoing equations. In general, for a given binding energy:

$$\Delta U=\mathrm{Max}(U(r)|_{r\geq R_T+R_C})-U(R_T+R_C) \tag{14}$$

$$\frac{1}{2}mv^2 \geq \Delta U \tag{15}$$

Relationships of this sort can be used to find proper proportionalities between toning system components. For example, for optimum performance: a toner with mass $M_T$=m and radius $R_T$ tribocharged on a carrier of radius $R_C$ in a toning station with average velocity toward the imaging member v needs q/m that approximately satisfies (9), q that satisfies (11), or charge density $\sigma_T$ (12) that satisfies (13). There are many means of adjusting the developer charge to mass ratio. For example, charge agents may be applied to the toner or the carrier, small third components may be added to the developer mix, and adjustments to toner concentration may all be used to alter the charge to mass ratio of the developer. Decreasing the toner concentration increases toner charge, as is well known in the literature.

Figure 9:
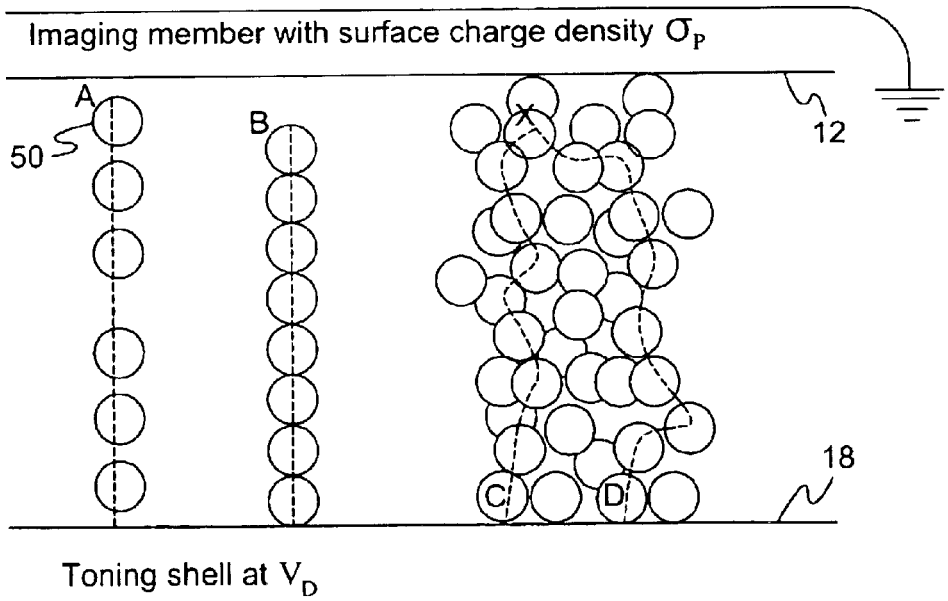
FIG. 9 presents a diagrammatic depiction of various electric field pathways.

Limits on the desirable range of q/m can also be related to the ranges of velocities in the system. The following is an example with a simple potential. The electric field in the developer gap, i.e., across the toning nip 34, of FIG. 2 is determined by the electrical bias applied to the developer 16, charge density or electrical bias on the imaging member 12, the dielectric constants of the developer 16 and of the imaging member 12, and the thickness of these layers. Assuming that the carrier particles are conductive or that they have a high dielectric constant, the electric field inside the carrier particles can be taken to be approximately zero. The electric field at the surface of the imaging member 12 has an average value greater than or equal to that determined by path A of FIG. 9. The maximum value of the electric field is determined by path B or a similar path. Moreover, the electric field at any point should be independent of the path from the toning shell to that point, as illustrated by paths C and D, both of which result in the same electric field. Assume for simplicity that an electrostatic image carried on the imaging member has just entered the toning nip 34, the imaging member 12 is completely discharged so that its free charge density $\sigma_P$=0, or in the case of a conductive receiver, the imaging member 12 is grounded, and no toner has been deposited on the imaging member yet. Then $$E_D = \frac{V_D}{\frac{t_D}{\varepsilon_D}+\frac{t_P}{\varepsilon_P}} \tag{16}$$

where $V_D$ is the developer bias potential, $t_D$ is the length of a path not including any distance inside carrier particles, $\epsilon_D$ is the dielectric constant for this path, assumed to be 1, $t_P$ is the imaging member thickness, typically 18 microns, and $\epsilon_P$=3 is the dielectric constant of the imaging member 12. For a conductive imaging member, $t_p$ is zero.

Assume that the toning shell 18 is electrically biased at 300 V. For the average field on path A, a packing fraction of 60% in the toning nip 34 results in $t_D$=40% of 0.018 inches where E is nonzero outside of the particles, and the electric field at the imaging member E=54.7 statvolts/cm (neglecting the imaging member thickness in this calculation). For the maximum field, a path similar to path B results in a path length of approximately $R_C+t_p/3$ and a maximum field E=527 statvolts/cm.

The potential U(r) including the electric field is $$U(r) = \frac{-q^2}{r} - qEr\cos\theta \tag{17}$$

Figure 10:
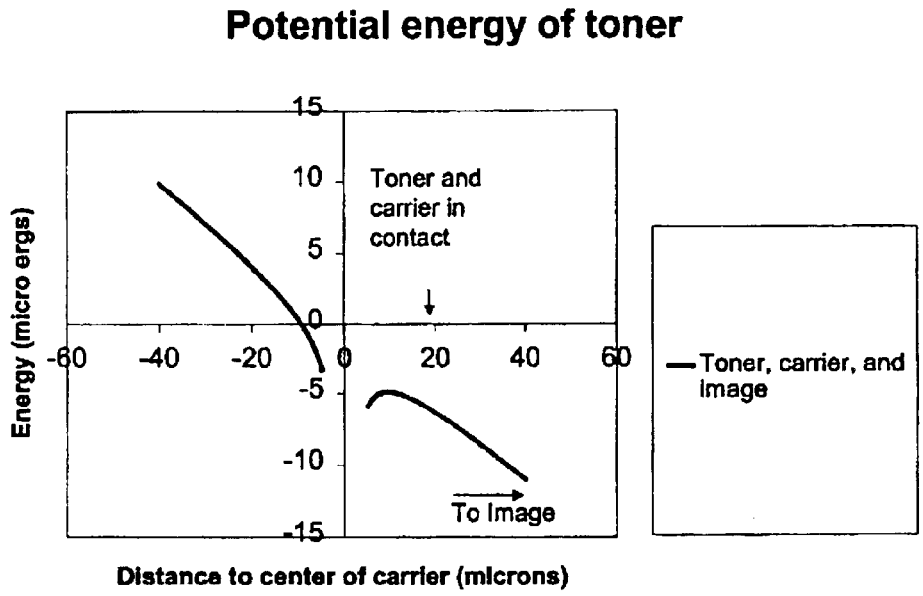
FIG. 10 presents a plot of toner potential as a function of the separation distance between the centers of toner particle and carrier particle.

As shown in FIG. 10, the Coulomb and qE forces summed together are approximately zero when the potential is horizontal, at distance $r=(q/E\cos\theta)^{1/2}$ and the potential energy at this point is $-2q(qE\cos\theta)^{1/2}$. The preferred configuration of charge, toner radius, carrier radius, and electric field of image development puts the toner particle "on top of the hill" of potential energy at $r=R_C+R_T$ or on the downward slope farther away from the carrier particle. For the Coulomb potential, during the initial stages of image development, preferably $$R_C+R_T \geqq (q/E\cos\theta)^{1/2} \tag{18}$$

Similar relationships exist for other potentials that have r dependence. If $R_C+R_T<(q/E\cos\theta)^{1/2}$, the binding energy of the toner is given by $$\Delta U = \frac{q^2}{(R_c+R_T)} + qE(R_C+R_T)\cos\theta - 2q(qE\cos\theta)^{1/2} \tag{19}$$

Figure 11:
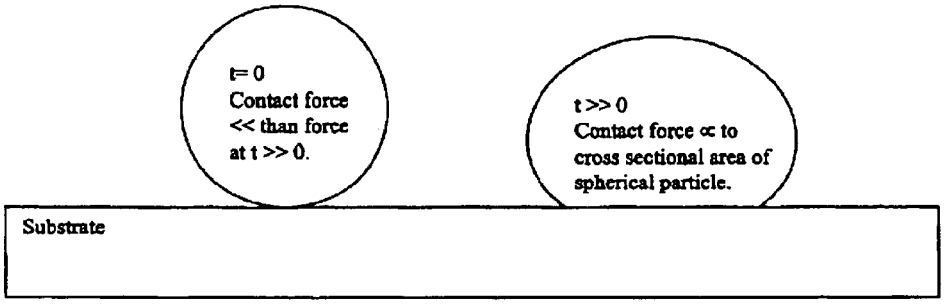
FIG. 11 presents a diagrammatic representation of a particle interacting with a surface.

Surface forces, adhesion forces, or dispersion forces $F_a$ from particle contact with a substrate, as shown in FIG. 11, can contribute an additional binding energy $\Delta U_a(r_T,R_C,s,t)$ to the potential U(r). The term surface forces can include forces arising from nonuniform electric charges, image charges from polarization of the carrier particle by the toner charge and vice-versa, polarization of both the toner and the carrier in the field of the imaging member image, dispersion forces, van der Waals forces, surface tension of adsorbed films, and chemical or hydrogen bonding forces. These forces are generally attractive, short-range, and can be schematically depicted in the potential energy diagram as a step function at the distance of closest contact $R_C+R_T$. After initial contact, surface forces increase as particles deform under the influence of the force and contact area increases. For t>>0, surface force is proportional to the cross-sectional area of the initially spherical particles. The surface forces for toner and carrier also depend on $R_C$, $R_T$ and the substrate (carrier) properties. At t=0, when the particle is only slightly in contact with the substrate, surface forces are probably an order of magnitude less than at t>>0. For toner particles tribocharged against carrier particles, it can be assumed that t>>0 when the image is developed.

It is very difficult to estimate the contribution of van der Waals forces and other adhesion forces or dispersion forces independently from the effects of polarization forces. These non-electrostatic adhesion forces become more important as toner size decreases, and they can be very large for smooth surfaces. The dispersion force for a perfectly smooth 11.5 micron toner and a perfectly smooth 26 micron carrier for the example system as given by Williams is $$F_a = \frac{A}{6D^2}\left(\frac{R_C R_T}{R_C + R_T}\right) = \frac{1\times10^{-12}\text{erg}\times\frac{11.5}{2}\times10^{-4}\text{cm}}{6\times(4\times10^{-8})^2}\left(\frac{26}{26+11.5}\right) = 0.042\ \text{dyne} \tag{20}$$

Where $A=\times10^{-12}$ erg is the Hamaker constant and D=4 angstrom is the distance of closest approach. This force dwarfs the Coulomb force of $6.5\times10^{-4}$ dynes from the toner charge of 20 $\mu$C/g and equal but opposite carrier charge. However, due to the short-range nature of the dispersion force, it corresponds to a binding energy of adhesion $\Delta U_a$ of only $1.36\times10^{-9}$ ergs, much lower than the Coulomb binding energy of approximately $1.22\times10^{-6}$ ergs.

Additionally, particles are usually not perfectly smooth. To fit experimental data to theoretical calculations, each particle is often assumed to have a few contact asperities with very small radii of curvature, typically in the range of 0.1 $\mu$m. For particles with 3 asperities in contact this results in a surface force of approximately 0.003 dyne.

$$F_a = \frac{3AR'}{6D^2} = \frac{3\times1\times10^{-12}\text{erg}\times1\times10^{-5}\text{cm}}{6\times(4\times10^{-8})^2} = 0.003\ \text{dyne} \tag{21}$$

This can be compared to data on the adhesion of particles of PMMA to aluminum (oxide) substrates by Nagayama et al. 2000, which show average adhesion forces $F_a$ on the order of $7.09\times10^{-4}$ dynes for 7.5 micron diameter particles. The measured force is proportional to cross-sectional area of the particles (Nagayama et al. 1999), and for 11.5 micron particles the corresponding surface force is $2\times10^{-3}$ dynes. This is within a factor of 2 of the result of Williams.

The binding energy from surface forces (for detachment) $\Delta U_a$=average force×distance moved until detached. For toner, reasonable approximations are that the particle can be freed at t>>0 by moving the particle (or more properly, moving its center of mass) >⅔ $R_T$ away from the surface, and that the surface force is nearly constant during removal (Gady, Rimai et al.) More generally, the removal distance is from ½ $R_T$ to $R_T$. Using the data of Nagayama et al., the potential energy contribution of the surface forces for 11.5 micron toner in contact with ferrite carrier can be approximated as a step function of magnitude $\Delta U_{aC}(R_T,R_C,s,t)\sim1\times10^{-6}$ ergs t>>0, where in contact the separation distance of the toner and carrier particles s=0, and t is the contact time. The step function corresponds to idealized surface forces that are very large (infinite) for an extremely small distance, and contributes an additional term $-h(R_C+R_T-r)\Delta U_{aC}(R_T,R_C,s,t)|_{t>>}0$ to the potential, where the Heaviside function h(x)=0 for x<0, and h(x)=1 for x>0.

Figure 12:
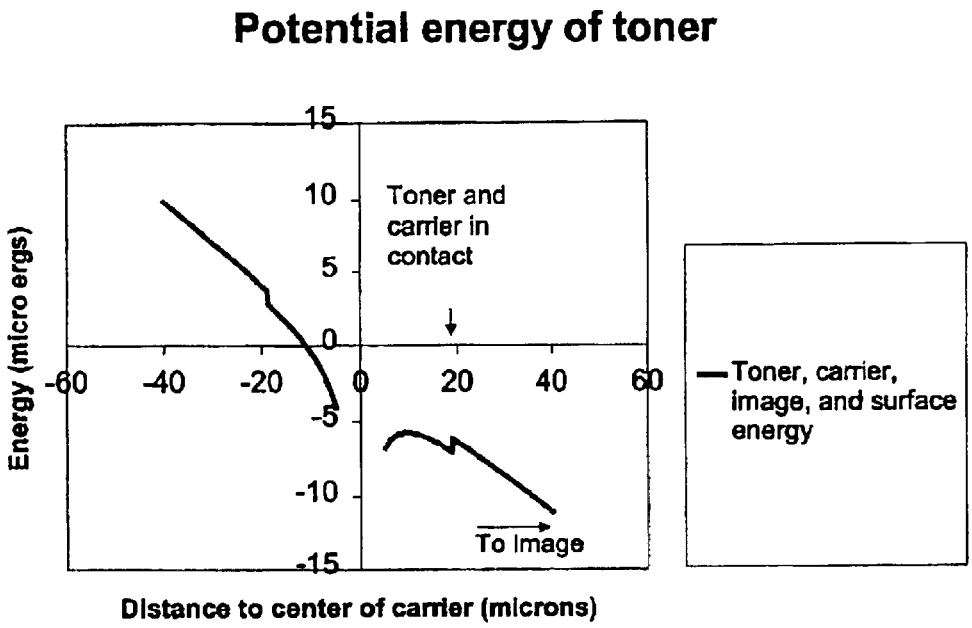
FIG. 12 presents a plot of toner potential as a function of the separation distance between the centers of toner particle and carrier particle.
Figure 13:
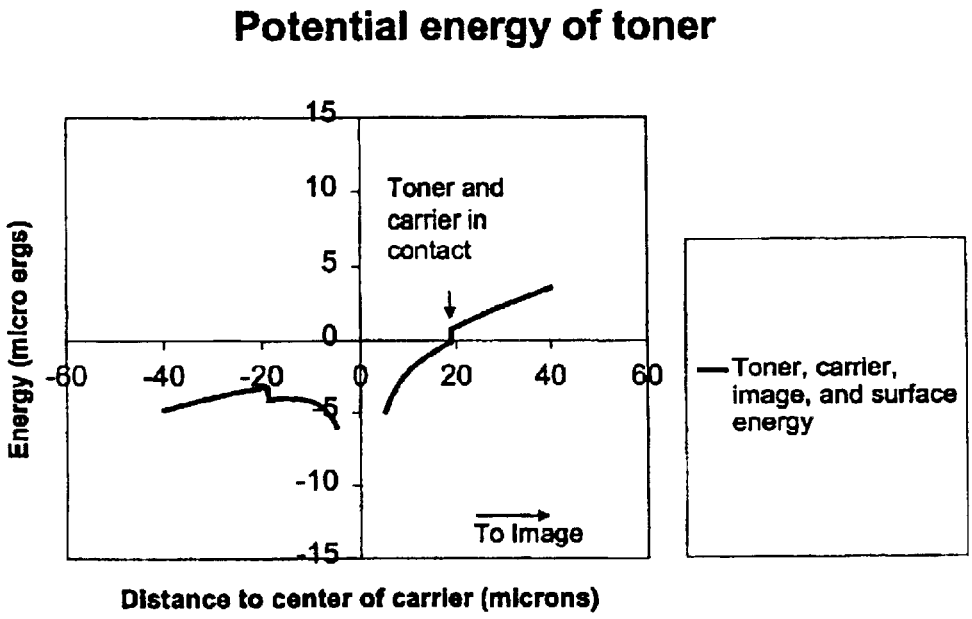
FIG. 13 presents a plot of toner potential as a function of the separation distance between the centers of toner particle and carrier particle.
Figure 14:
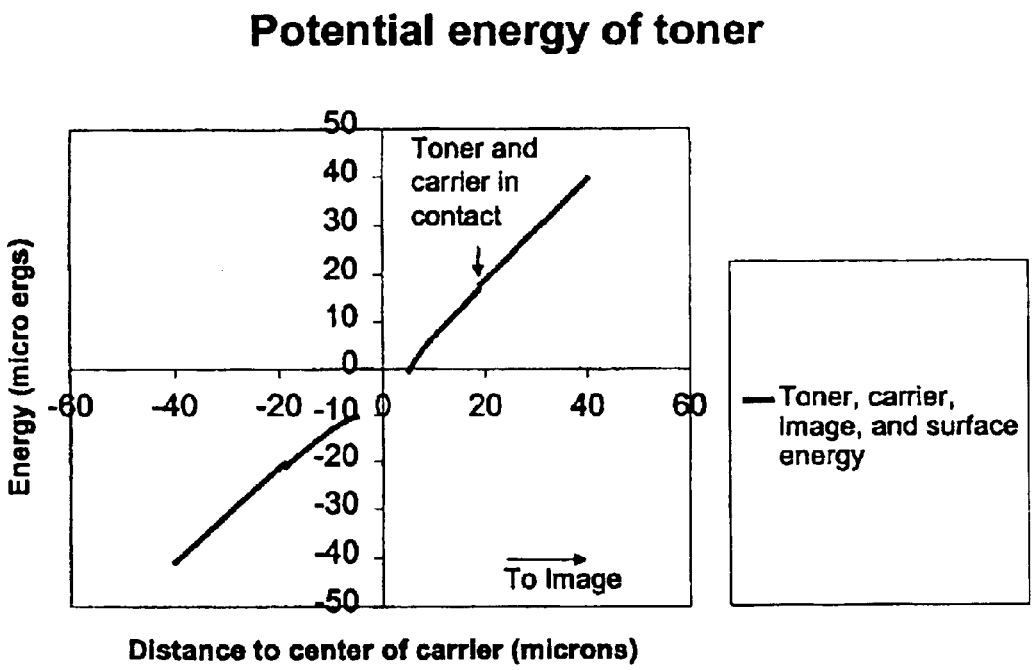
FIG. 14 presents a plot of toner potential as a function of the separation distance between the centers of toner particle and carrier particle.
Figure 15:
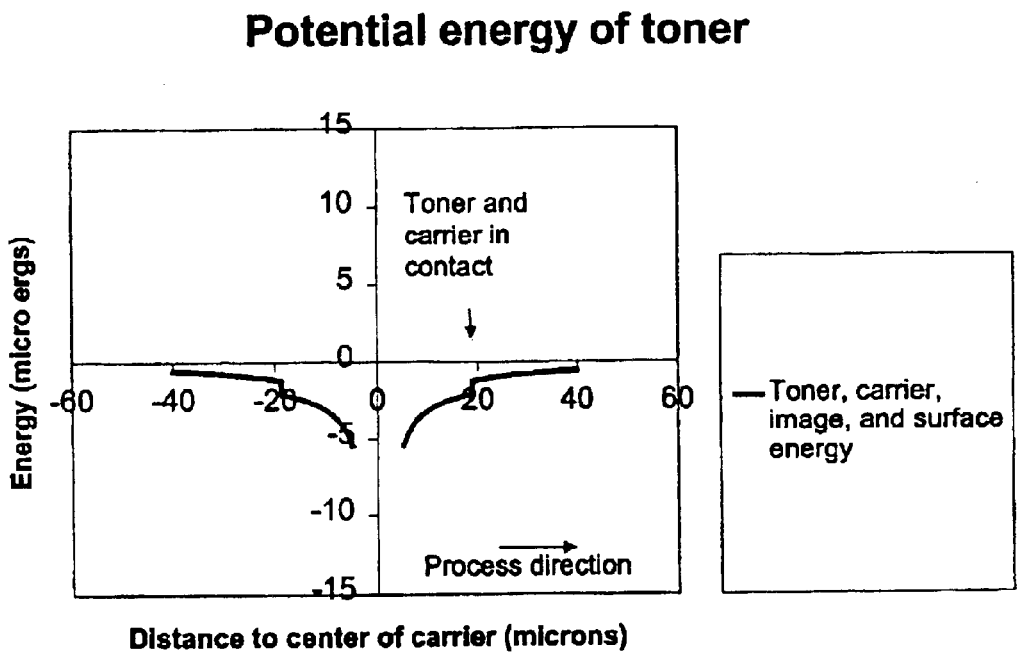
FIG. 15 presents a plot of toner potential as a function of the separation distance between the centers of toner particle and carrier particle.

The effect of short-range surface forces on the potential energy of a toner particle and an oppositely-charged carrier particle is shown in FIG. 12 for an example Coulomb potential. The average electric field of the imaging member image and toning shell is also present. The potential well shows the kinetic energy required for the toner particle to detach from the carrier particle must be greater than $1\times10^{-6}$ ergs, approximately the binding energy from surface forces for toners of 11.5 microns in diameter. As shown in TABLE 1, energies of this magnitude can result from collisions of the carrier with the imaging member. After toner is freed from the surface forces, the qE force moves it toward the image.

Due to the dependence of surface forces on $R_T^2$, the binding energy $\Delta U_{aC}$ from surface forces is proportional to $R_T^3$. In situations like that of FIG. 12, where surface forces dominate toner-carrier attraction, $$\frac{1}{2}mv^2 \geq kR_T^3 \tag{22}$$

and using the data of Nagayama et al., $$\frac{1}{2}mv^2 \geq 1.85\times10^3\times\frac{\pi}{2}R_T^3 \tag{23}$$

or, preferably, $$\frac{1}{2}mv^2 \geq 1.85\times10^3\times\pi R_T^3 \tag{24}$$

and $$\frac{1}{2}m(L\omega_{Mag})^2 \geq kR_T^3 \tag{25}$$

where m is the mass of the toner.

Numerous toners are suitable in the practice of the invention. Polyester based toners and styrene acrylate polymer based toners, for example and without limitation, as described in published U.S. patent application No. 2003/0073017 now U.S. Pat. No. 6,692,880, 2003/0013032 now U.S. Pat. No. 6,797,448, 2003/0027068, 2003/0049552, and unpublished U.S. patent application No. 10/460,528 —filed Jun. 12, 2003—"Electrophotographic Toner and Developer with Humidity Stabilty, and 10/460,514—filed Jun. 12, 2003—"Electrophotographic Toner with Uniformly Dispersed Wax" may be implemented. The 6,610,451 patent is incorporated by reference as if fully set forth herein. The toner may be surface treated, with silica for example, as is well known in the art. A polymethylmethacrylate (PMMA) surface treatment may also be implemented, for example catalogue number MP1201 available from Soken Chemical & Engineering Co., Ltd., Tokyo, Japan, and distributed by Esprix Technologies of Sarasota, Fla. The carrier particles may be $SrFe_{12}O_{19}$ coated with polymethylmethacrylate. Volume mean diameter of 20.5 microns (sigma=0.7 microns for ten production runs of a carrier material), measured using an Aerosizer particle sizing apparatus (TSI Incorporated of Shoreview, Minn.). Larger diameter carrier particles can be used. A suitable carrier has a coercivity of 2050 Gauss, a saturation magnetization of 55 emu/g, and a remnance of 32 emu/g, measured using an 8 kG loop on a Lake Shore Vibrating Sample Magnetometer (Lake Shore Cryotronics, Inc., of Westerville, Ohio).

It should be understood that while the discussion herein might generally describe embodiments directed toward printers, the concepts discussed might also be applied to any other powder deposition device. Therefore, any reference to "printer" or "printers" should not be construed as strictly limited to these types of devices but rather might apply to any other powder deposition device as well. Powder deposition devices and techniques are discussed in co-pending U.S. Provisional Patent Application Ser. No. 60/551464, titled "Powder Coating Apparatus and Method of Powder Coating Using an Electromagnetic Brush," filed on Mar. 9, 2004, which is commonly assigned, and which is incorporated herein by reference.

Experimentally, the toner charge to mass ratio q/m can be measured by means disclosed in Schein, Maher, or Williams.

Also, development is known to approximately follow exponential time dependence with characteristic time $\tau$ similar to the discharging of a capacitor (Maher).

The Equilibrium Theory (Scbein) is widely accepted as the mechanism of particle deposition with insulative magnetic brush development. Polymeric toner particles are bound to the carrier particles by electrostatic forces and also by surface forces. In the Equilibrium Theory, toner is freed from the carrier and deposited on the receiver or substrate only in three-body contact events in which, for electrographic development systems, the toner simultaneously contacts both the carrier and the substrate. During this contact event, surface forces between the polymeric toner particle and the substrate counteract surface forces holding the toner particle to the carrier, and the particle is deposited on the substrate by electrostatic forces.

Rotating magnetic brush development is not described by the Equilibrium Theory. Deposition rates for rotating magnetic brush development typically exceed predictions of the Equilibrium Theory, which does not take into account the significant effect of brush agitation produced by the rotating magnetic core.

In the Equilibrium Theory, mass per unit area for particle deposition on a conductive substrate is given by (Schein, 1996 Eq. 6.56), $$\frac{M}{A} = \frac{\varepsilon_0 V}{Q/M}\frac{v}{\Lambda} \tag{26}$$

where M/A is mass per unit area in g/cm$^2$, Q/M is the charge-to-mass ratio for the polymeric particle in units of C/g, $\epsilon_0$ is the permittivity of free space in F/cm, V is the voltage between the substrate and the toning shell, $\nu$ is the ratio of the velocity of the development roller to the velocity of the substrate, and $\Lambda$ is the dielectric distance from the applicator roller electrode to the carrier charge in cm. The parameter $\Lambda$ is usually fitted to experimental data.

To determine $\Lambda$, powder depositions were made directly onto an aluminum substrate on a web press using commercially available materials and hardware from commercially available equipment made by Heidelberg Digital L.L.C.

A black commercial styrene butylacrylate toner (D1; Heidelberg Digital L.L.C., Rochester, N.Y.) was used. The extruded blend is pulverized to powder form and classified to yield a volume mean of 11.5 microns by Coulter Counter.

A developer was prepared from the above powder at a paint concentration of 15 weight percent with a strontium ferrite hard magnet core powder (Powdertech Corporation, Valparaiso, Ind.) coated with 0.3 pph of polymethylmethacrylate (Soken 1201, Japan). The carrier was coated with this polymer by admixing the polymer with the carrier, followed by heating the admixture in an oven to a point sufficient to fuse the polymer to the carrier. The carrier had a volume mean of 21 microns by Coulter Counter. The developer was prepared by agitating on a paint shaker for 1 minute.

Shell speeds of 423 RPM were used, corresponding for a 2 inch diameter shell to a surface speed of 1.125 m/sec. The spacing from the shell surface to the receiver was 30 mils, and the skive was set to 45 mils. Nap height for the developer material is approximately 48 mils. For comparison with the Equilibrium Theory, $\Lambda$ was determined by measuring mass area density with the magnetic core fixed at receiver speeds of 0.5 m/s, toner charge to mass ratio of 14.26 $\mu$C/g, and bias voltage of 1 kV. Data was taken at shell speeds of 129.1 RPM, corresponding to a surface speed 0.34 m/s, with a skive setting of 28 mils. Data was also taken at shell speeds of 423 RPM, corresponding for a 2 inch diameter shell to a surface speed of 1.125 m/sec with a skive setting of 45 mils. The spacing from the shell surface to the receiver was 30 mils for both shell speeds. For the low shell speed, low skive setting, mass area density was 10.38 g/cm$^2$ and $\Lambda$ was found to be approximately 41 microns, For the high shell speed, high skive setting, mass area density was 32.08 g/cm$^2$ and $\Lambda$ was found to be approximately 44 microns. For smaller spacings from the toning shell to the receiver, the dielectric length $\Lambda$ is expected to decrease slightly.

If the transit time of the receiver through the development nip is long compared to the characteristic time of development $\tau$ (Maher), then development can approach completion. It is believed in general, not depending on a particular theory, that a stable equilibrium can be reached with rotating core magnetic development at high pole transition rates exceeding approximately 256 pole flips per second, and that this state can particularly be reached with surface treated toners. It has been found experimentally that, in this equilibrium state, the voltage to completion, defined as the difference in magnitude between the potential of the toning shell and the potential of the developed image, is proportional to the charge-to-mass ratio of the toner particles cubed.

Equilibrium of toner in the developed image with toner in the magnetic brush can occur when the flux of toner particles from the magnetic brush onto the receiver equals the flux of toner particles from the receiver back into the magnetic brush. Assuming, when the image is in equilibrium with the developer, that the flux of toner toward the substrate J+ is equal and opposite to the flux J− of toner scavenged from the substrate back to the image, and using pheomenological equations for flux (adapted from Schwinger et al.), $$J_+ = \sigma E \propto V \tag{27}$$

$$J_- = \frac{-n_f Q^2 K}{m\lambda}\int \frac{Q}{r^2} e^{-\lambda(t-t')} dt' \propto Q^3 \text{ or } \left(\frac{Q}{m}\right)^3 \tag{28}$$

where $\sigma$ is conductivity, E is the electric field at the surface of the developed image, V is the potential difference between the toning shell and the surface of the developed image, where V is probably related to E by the dielectric length $\Lambda$, m=toner mass, $n_f$ is the number of free toner particles per unit volume, r is distance from a toner particle to a carrier center, $\lambda$ is the characteristic decay time for the velocity of free toner in the developer due to scattering with other particles, and K is a proportionality constant relating toner charge to carrier charge. The voltage of the developed image can be measured using a non-contact electrostatic voltmeter, such as a Trek model 344, manufactured by Trek, Inc., Medina, N.Y. The voltage of the toning shell can be determined by using a voltmeter, as is well known in the art.

Experiments were performed using a development system consisting of a rotating magnetic core, a rotating toning shell, and a skive. Development was performed onto a photoconductor, using a variety of toners, including DX toner, a commercially available material consisting of 100 parts crosslinked poly(styrene butyl acrylate), 6 parts of carbon black, and 1.5 parts of T77 charge agent, an organo-iron complex manufactured by Hodagaya. The particle size on average of DX is 11.5 microns diameter. A toner designated as T100 was used, consisting of 100 parts poly(ethoxy bisphenolA fumerate), a polyester, 8 parts Regal 330 carbon black, 2 parts Viscol 550P, an alcohol-functional polyethylene wax, 2 parts Polywax 3000, and 2 pph Bontron E84 charge agent. This material was surface treated with 0.5 parts R972 $SiO_2$ manufactured by Degussa. The particle size on average of T100 is 11.5 microns diameter. A toner designated as T9 was used, consisting of 100 parts poly (ethoxy bisphenolA fumerate), a polyester, 7 parts Regal 330 carbon black, 2 parts Viscol 550P, an alcohol-functional polyethlyene wax, 2 parts Polywax 3000, and 2 pph Bontron E84 charge agent. This material was surface treated with 0.3 parts R972 $SiO_2$ manufactured by Degussa. The particle size on average of T9 is 9 microns diameter. Developers were made with these materials using procedures equivalent to that described earlier with a carrier of approximately 26 microns average diameter. Data was taken at process speeds ranging from 17.49 inches per second, the equivalent of 110 PPM, to 33.39 inches per second, the equivalent of 210 PPM. At 17.49 inches per second, core speeds of approximately 877 RPM were used, corresponding, for a 14 pole magnetic core, to approximately 205 pole flips per second, and shell speeds of 125.5 RPM were used, corresponding for a 2 inch diameter shell to surface speeds of approximately 13.14 inches per second. For higher process speeds, the core speed and shell speed were increased proportionally with the process speed. For example, at the process speed of 23.85 inches per second, corresponding to 150 PPM, a core speed of 1196.5 RPM was used, corresponding to approximately 279 pole flips per second. At the process speed of 23.85 inches per second, corresponding to 150 PPM, a shell speed of 171.14 RPM was used, corresponding to approximately 17.92 inches per second. For all process speeds, the spacing of the skive to the toning shell was 28 mils, and the spacing between the photoconductor and the skive was nominally set to 14 mils, but was probably approximately 18 mils in actuality, due to the flexible photoconductor being pushed away from the toning shell by the magnetic brush. The toner charge to mass ratio was measured using equipment described in Maher.

Figure 16:
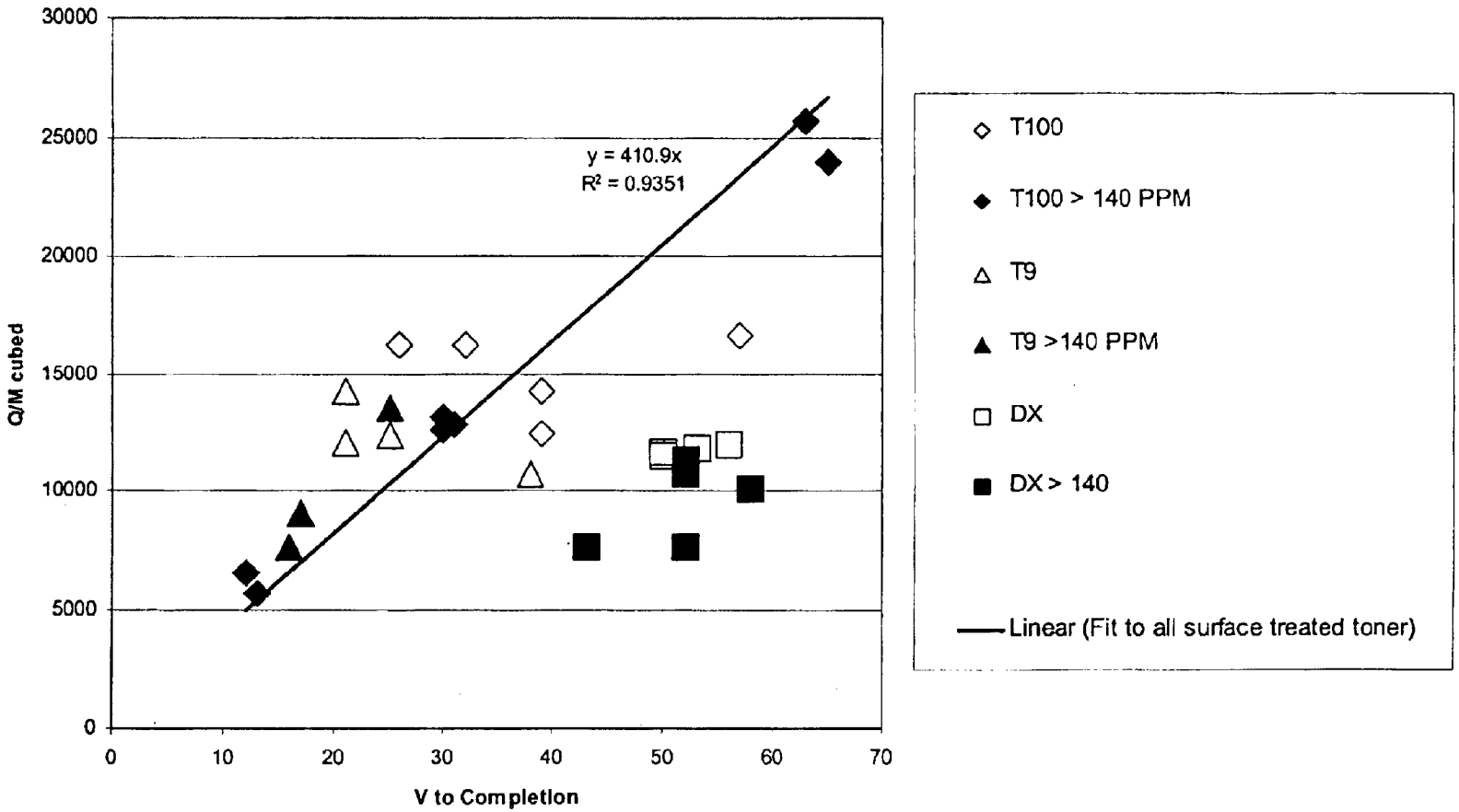
FIG. 16 present a plot of toner charge to mass ratio cubed vs voltage to completion for toner developed onto a receiver.

Results are shown in FIG. 16 and TABLE 2.

TABLE 2

| T100 toner | | | T9 toner | | | DX toner | | |
|---|---|---|---|---|---|---|---|---|
| Speed (PPM) | V to Completion (V) | Q/m Cubed (uC/g)^3 | Speed (PPM) | V to Completion (V) | Q/m Cubed (uC/g)^3 | Speed (PPM) | V to Completion (V) | Q/m Cubed (uC/g)^3 |
| 110 | 57 | 16620.42 | 110 | 21 | 14225.26 | 110 | 56 | 11993.26 |
| 120 | 39 | 12454.9 | 120 | 25 | 12382.5 | 120 | 53 | 11828.97 |
| 130 | 39 | 14269.34 | 130 | 38 | 10706.19 | 130 | 50 | 11666.19 |
| 140 | 26 | 16251.95 | 140 | 21 | 12064.14 | 140 | 50 | 11504.91 |
| 140 | 32 | 16251.95 | 150 | 25 | 13532.32 | 150 | 52 | 11345.12 |
| 150 | 30 | 13110.87 | 180 | 16 | 7662.85 | 180 | 52 | 10698.9 |
| 180 | 31 | 12854.01 | 210 | 17 | 9050.929 | 180 | 43 | 7657.022 |
| 180 | 65 | 23962.6 | | | | 210 | 52 | 7657.022 |
| 180 | 12 | 6570.726 | | | | 210 | 58 | 10077.7 |
| 210 | 30 | 12600.54 | | | | | | |
| 210 | 63 | 25646.28 | | | | | | |
| 210 | 13 | 5696.976 | | | | | | |

Development to completion is preferred for electrographic image development systems or powder deposition systems because it produces a very stable image that is relatively insensitive to fluctuations in toner concentration or fluctuations in the speeds of the receiver or of the toning station components. The reason for this image stability is that the image is in equilibrium with the developer nap, and if, during a portion of the transition time of the receiver through the magnetic brush, more toner than average happens to be deposited onto the image because of a fluctuation, the excess toner is removed when the system returns to equilibrium. Likewise, during a portion of the transition time of the receiver through the magnetic brush if a fluctuation produces a lower density than average, more toner is deposited later. If development to completion is not reached, then the effects of these fluctuations are additive during the nip transition time, and a brief period of low toner deposition due to a fluctuation in toner concentration, shell speed, core speed, or another characteristic of the system is unlikely to be counteracted with a period of high toner deposition.

The following publications are hereby incorporated by reference as if fully set forth herein:

E. M. Williams, *The Physics and Technology of Xerographic Processes* (Krieger Publishing Company, Malabar, Fla. 1993);

M. Nagayama and M. Takeuchi, "Particle Adhesion Force Measurements by Electric Field Detachment Method" in *IS&T's NIP* 16:2000 *International Conference on Digital Printing Technologies* (IS&T: The Society for Imaging Science and Technology, Springfield, Va. 2000) pp. 731–735;

M. Nagayama and M. Takeuchi, "Particle Adhesion Force Measurements by Toner Jumping Method" in *IS&T's NIP* 15:1999 *International Conference on Digital Printing Technologies* (IS&T: The Society for Imaging Science and Technology, Springfield, Va. 1999) pp. 582–585;

B. Gady, D. J. Quesnel, D. S. Rimai, S. Leone, and P. Alexandrovich, "Surface Treatment and Its Effects on Toner Adhesion, Cohesion, Transfer, and Image Quality" in *IS&T's NIP* 14: 1998 *International Conference on Digital Printing Technologies* (IS&T: The Society for Imaging Science and Technology, Springfield, Va. 1998) pp. 363–366;

J. Maher, "Characterization of Toner Adhesion to Carrier: A Phenomenological Model" in *Recent Progress in Toner Technology* (IS&T: The Society for Imaging Science and Technology, Springfield, Va. 1997) pp. 12–15;

J. Schwinger, L. L. DeRaad, Jr., K. A. Milton, W. Tsai, *Classical Electrodvamics (Perseus Books, Reading Mass.,* 1998).

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. For example, the invention can be used with electrographic or electrographic images and with powder coating systems. The invention can be used with imaging elements or imaging members in either web or drum formats. Optimized setpoints for some embodiments may be attained using reflection density instead of transmission density, and the exact values of optimum setpoints may depend on the geometry of particular embodiments or particular characteristics of development in those embodiments. It is therefore intended to include within the invention all such variations and modifications as fall within the scope of the appended claims and equivalents thereof.

What is claimed is:

1. An electrographic printer, comprising:

an imaging member, a toning shell located adjacent the imaging member and defining an image development area therebetween, through which developer is passed; and a rotating magnetic core comprising a plurality of magnetic poles arranged such that adjacent poles are of opposite polarity, the magnetic core located adjacent the toning shell, subjecting the developer to magnetic pole transitions at a rate exceeding 257 pole transitions per second as measured from the frame of reference of a stationary observer, the toning shell comprising a toning shell voltage, the imaging member comprising a developed image, the developed image comprising a developed image voltage, the toning shell voltage minus the developed image voltage being proportional to a toner charge to mass ratio of the developer cubed.

2. An electrographic printer, comprising:

an imaging member, a toning shell located adjacent the imaging member and defining an image development area therebetween, through which developer is passed; and a rotating magnetic core comprising a plurality of magnetic poles arranged such that adjacent poles are of opposite polarity, the magnetic core located adjacent the toning shell, subjecting the developer to magnetic pole transitions at a rate exceeding 257 pole transitions per second as measured from the frame of reference of a stationary observer, the toning shell comprising a toning shell voltage, the imaging member comprising a developed image, the developed image comprising a developed image voltage, the toning shell voltage minus the developed image voltage being proportional to an average charge per toner particle of the developed image cubed.

3. An electrographic printer, comprising:

an imaging member, a toning shell located adjacent the imaging member and defining an image development area therebetween, through which developer is passed; and a rotating magnetic core comprising a plurality of magnetic poles arranged such that adjacent poles are of opposite polarity, the magnetic core located adjacent the toning shell, subjecting the developer to magnetic pole transitions at a rate exceeding 257 pole transitions per second as measured from the frame of reference of a stationary observer, the developer comprising carrier particles, developer comprising a measured dielectric length less than 3 times the average diameter of the carrier particles.

4. An electrographic printer, comprising:

an imaging member, a toning shell located adjacent the imaging member and defining an image development area therebetween, through which developer is passed;

a rotating magnetic core comprising a plurality of magnetic poles arranged such that adjacent poles are of opposite polarity, the magnetic core located adjacent the toning shell;

the toning shell comprising a toning shell voltage;

the imaging member comprising a developed image;

the developed comprising a developed image voltage; and the toning shell voltage minus the imaging voltage being proportional to a toner charge to mass ratio of the developer cubed.

5. The electrographic printer of claim 4, the toning shell comprising a toning shell voltage, the imaging member comprising a developed image, the developed image comprising a developed image voltage, the toning shell voltage minus the developed image voltage being proportional to an average charge per toner particle of the developed image cubed.

6. The electrographic printer of claim 4, the developer comprising surface treated toner.

7. The electrographic printer of claim 4, the developer comprising polyester toner.

8. The electrographic printer of claim 4, the developer comprising surface treated polyester toner.

9. The electrographic printer of claim 4, the developer comprising toner and carriers, the toner comprising a toner charge, the carrier comprising a carrier charge, the toner charge being proportional to the carrier charge.

10. The electrographic printer of claim 4, the developer comprising carrier particles, the developer comprising a measured dielectric length less than 3 times the average diameter of the carrier particles.

11. An electrographic printer, comprising:

an imaging member, a toning shell located adjacent the imaging member and defining an image development area therebetween, through which developer is passed;

a rotating magnetic core comprising a plurality of magnetic poles arranged such that adjacent poles are of opposite polarity, the magnetic core located adjacent the toning shell;

the toning shell comprising a toning shell voltage;

the imaging member comprising a developed image;

the developed image comprising a developed image voltage; and the toning shell voltage minus the developed image voltage being proportional to average charge per toner particle of the developed image cubed.

12. The electrographic printer of claim 11, comprising subjecting the developer to magnetic pole transitions at a rate exceeding 257 pole transitions per second as measured from the frame of reference of a stationary observer.

13. The electrographic printer of claim 11, the toning shell comprising a toning shell voltage, the imaging member comprising a developed image, the developed image comprising a developed image voltage, the toning shell voltage minus the developed image voltage being proportional to a toner charge to mass ratio of the developer cubed.

14. The electrographic printer of claim 11, the developer comprising surface treated toner.

15. The electrographic printer of claim 11, the developer comprising polyester toner.

16. The electrographic printer of claim 11, the developer comprising surface treated polyester toner.

17. The electrographic printer of claim 11, the developer comprising toner and carriers, the toner comprising a toner charge, the carrier comprising a carrier charge, the toner charge being proportional to the carrier charge.

18. The electrographic printer of claim 11, the developer comprising carrier particles, the developer being comprising a measured dielectric length less than 3 times the average diameter of the carrier particles.

19. An electrographic printer, comprising:

an imaging member, a toning shell located adjacent the imaging member and defining an image development area therebetween, through which developer is passed;

a rotating magnetic core comprising a plurality of magnetic poles arranged such that adjacent poles are of opposite polarity, the magnetic core located adjacent the toning shell; and the developer comprising toner and carriers, the toner comprising a toner charge, the carrier comprising a carrier charge, the toner charge being proportional to the carrier charge, the toning shell comprising a toning shell voltage, the imaging member comprising a developed image, the developed image comprising a developed image voltage, the toning shell voltage minus the developed image voltage being proportional to a toner charge to mass ratio of the developer cubed.

20. An electrographic printer, comprising:

an imaging member, a toning shell located adjacent the imaging member and defining an image development area therebetween, through which developer is passed;

a rotating magnetic core comprising a plurality of magnetic poles arranged such that adjacent poles are of opposite polarity, the magnetic core located adjacent the toning shell; and the developer comprising toner and carriers, the toner comprising a toner charge, the carrier comprising a carrier charge, the toner charge being proportional to the carrier charge, the toning shell comprising a toning shell voltage, the imaging member comprising a developed image, the developed image comprising a developed image voltage, the toning shell voltage minus the developed image voltage being proportional to an average charge per toner particle of the developed image cubed.

21. An electrographic printer, comprising:

an imaging member, a toning shell located adjacent the imaging member and defining an image development area therebetween, through which developer is passed;

a rotating magnetic core comprising a plurality of magnetic poles arranged such that adjacent poles are of opposite polarity, the magnetic core located adjacent the toning shell; and the developer comprising toner and carriers, the toner comprising a toner charge, the carrier comprising a carrier charge, the toner charge being proportional to the carrier charge, the developer comprising carrier particles, developer comprising a measured dielectric length less than 3 times the average diameter of the carrier particles.

22. An electrographic printer, comprising:

an imaging member, a toning shell located adjacent the imaging member and defining an image development area therebetween, through which developer is passed;

a rotating magnetic core comprising a plurality of magnetic poles arranged such that adjacent poles are of opposite polarity, the magnetic core located adjacent the toning shell; and the developer comprising carrier particles, the developer comprising a measured dielectric length that is less than 3 times the average diameter of the carrier particles.

23. The electrographic printer of claim 22, the toning shell comprising a toning shell voltage, the imaging member comprising a developed image, the developed image comprising a developed image voltage, the toning shell voltage minus the developed image voltage being proportional to a toner charge to mass ratio of the developer cubed.

24. The electrographic printer of claim 22, the toning shell comprising a toning shell voltage, the imaging member comprising a developed image, the developed image comprising a developed image voltage, the toning shell voltage minus the developed image voltage being proportional to an average charge per toner particle of the developed image cubed.

25. The electrographic printer of claim 22, the developer comprising surface treated toner.

26. The electrographic printer of claim 22, the developer comprising polyester toner.

27. The electrographic printer of claim 22, the developer comprising surface treated polyester toner.

* * * * *